United States Patent [19]

Reale

[11] 3,940,902

[45] Mar. 2, 1976

[54] FULCRUM TILT BUILDING SYSTEM

[76] Inventor: Lucio V. Reale, 1311 Grenade St., Chambly, Quebec, Canada

[22] Filed: Apr. 1, 1974

[21] Appl. No.: 457,082

[52] U.S. Cl. ..... 52/745; 52/79; 52/236

[51] Int. Cl.[2] ..... E04G 21/00

[58] Field of Search ..... 52/79, 236, 745, 167

[56] References Cited

UNITED STATES PATENTS

| | | | |
|---|---|---|---|
| 845,046 | 2/1907 | Bechtold | 52/167 |
| 2,722,040 | 11/1955 | Ludowici | 52/742 |
| 3,302,362 | 2/1967 | Lang | 52/743 |
| 3,305,991 | 2/1967 | Weismann | 52/612 |
| 3,462,908 | 8/1969 | Wysocki | 52/745 |
| 3,510,999 | 3/1970 | Habacher | 52/167 |
| 3,776,990 | 12/1974 | Watkins | 52/745 |

FOREIGN PATENTS OR APPLICATIONS

| | | | |
|---|---|---|---|
| 679,137 | 9/1952 | United Kingdom | 52/745 |
| 711,894 | 9/1931 | France | 52/745 |
| 892,579 | 4/1944 | France | 52/745 |
| 1,020,471 | 2/1953 | France | 52/745 |

*Primary Examiner*—Ernest R. Purser
*Assistant Examiner*—Henry Raduazo
*Attorney, Agent, or Firm*—Larson, Taylor & Hinds

[57] ABSTRACT

A method of constructing buildings is disclosed wherein a multicellular monolithic structure is formed with walls and future floors all in a vertical plane. The walls may be formed from concrete or other laminate material. The structure is then tilted about tilt points along a tilt line which is retained in a V-groove attached to a base until the structure reaches a vertical location. After the tilting step the structure is levelled by means of jacks. Wedges are inserted to support the structure and the jacks are removed. Several structures may be assembled to form a building. Cantilever walls may be added which join together to form a corridor or hall between structures.

7 Claims, 10 Drawing Figures

FULCRUM TILT BUILDING SYSTEM

This invention relates to a method for constructing buildings, and more particularly, to a method of forming a multicellular, monolithic structure with vertical walls and floor slabs, tilting the structure to an upright position and adding the end walls.

There are a number of well known methods for constructing buildings, such as apartments, office blocks, etc. Most of these types of buildings require a concrete floor, the floor either being poured or cast in place or, alternatively, pre-fabricated or pre-cast and erected in panels or blocks as the building rises. In some cases, a complete building is formed of concrete panels or units which are pre-cast; the units may be formed of single cell structural sections of one or more stories, which are mounted one upon the other to form the building. Alternatively, they may be panels which are assembled to form walls and floors; or another method, perhaps the most common method, is constructing a building by making forms and pouring the walls and then the floor on top of the walls as the building rises. Other methods exist for constructing buildings, such as casting concrete panels or units on ground level and then lifting them up and assembling them in position. Some buildings have steel structures to support the floors; in such buildings the steel is first erected, and then pre-cast concrete slabs are assembled on the steel beams or alternatively forms are positioned for pouring a concrete slab in place. Masonry brick walls may sometimes be used for bearing walls but not generally for floors.

In conventional construction methods, one commences with the foundation walls and works up. If the floors are being cast in place, forms have to be positioned on each floor. The forms may be reausable but they have to be well supported to prevent the liquid concrete spilling and causing accidents. If the walls and floors are pre-cast concrete slabs, then when they are erected in place one is faced with moving a large number of components which requires the continual use of hoists or cranes and consequently a high labour content with this method. All these conventional methods of concrete construction include cold joint forming between the structural components.

It is an object of the present invention to provide a method for constructing a multi-cellular monolithic structure which does not require pouring concrete in flat horizontal floor panels, neither does it require the assembly of the building in many components.

To obtain this and other objects of the present invention, the method of constructing should be efficient and economical; it should meet all architectural, structural, mechanical and construction requirements, and should be adaptable for various types of structures and designs. Such a building method should make the building simpler and more economical to build and preferably avoid the use of concrete forms that have to be moved and reused as the building rises.

The present invention includes a method of constructing a building comprising the steps of assembling at least one multi-cellular, monolithic structure in the horizontal plane having only vertical walls and floor slabs, tilting the structure about a tilt line to raise it to a vertical location, and levelling the structure after the tilting step.

The multicellular, monolithic structure is first formed at ground level with the walls and floors being in the vertical plane and then tilted about tilt points along a tilt line of the structure through 90° to the upright position to form the building structure. It is then necessary to finish the building by the construction of end walls, which may be curtain wall construction, masonry brick walls or other suitable types erected on site. A multicellular, monolithic structure has advantages over the single cell monolithic structure, as multicellular structures have only one wall between cells, whereas a single cell monolithic structure requires a wall around each cell. Thus there are two walls between cells in the single cell monolithic structure against only one wall between cells in a multicellular monolithic structure.

Another advantage of the multicellular, monolithic structure is strength. In a single cell monolithic structure, it is generally necessary to calculate bending moment using the $WI^2/8$ formula for simple supported spans and, in view of the fact that each cell in the system is separate, the bending moment must be calculated individually. However, for the multicellular, monolithic structure, one can consider it as one component; thus the stresses may be calculated as extending over all the walls and floors in the structure with a considerable advantage in strength. This means that a reduced thickness of the concrete slab and a relative reduction of the steel area in the concrete may be obtained which consequently reduces the weight of the structure.

A further advantage of the present invention is apparent when concrete structures are being considered. Whatever method of forming is used to obtain a multicellular, monolithic structure, the concrete walls and slabs are all poured vertically.

These and other objects of the present invention will be apparent from the following detailed specifications and the accompanying drawings which illustrate embodiments of the invention:

Figure 1:
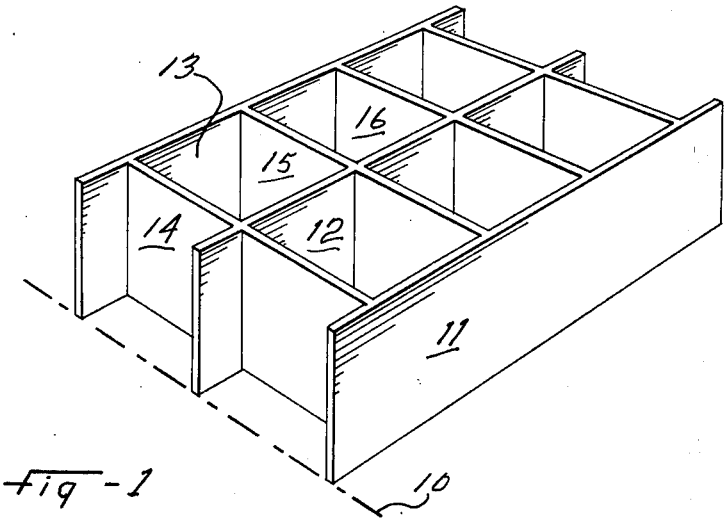
FIG. 1 is a schematic perspective view of a multicellular, monolithic structure of the present invention.

Referring now to the drawings, a multicellular, monolithic structure is shown in FIG. 1, assembled about a fulcrum tilt line 10. The three vertical walls 11, 12 and 13 extend perpendicular from the tilt line 10. Between the vertical walls 11, 12 and 13 spaced apart to form rectangular cells are three further walls 14, 15 and 16. The walls are all integrally formed together, thus forming the multicellular, monolithic structure. The walls may be made from a number of known building materials, perhaps the most common today being concrete which is poured into forms with reinforcing steel in place to strengthen the walls. The concrete may be poured by a number of methods, such as a slip-form method, a removable and reversible form method, and others known to those skilled in the art. It is important that no cold joints occur in the structure as this reduces its strength.

Another method of constructing the multicellular, monolithic structure, such as that shown in FIG. 1, is according to my method shown in Canadian Pat. No. 887,175 which issued Nov. 30, 1971. This patent discloses the use of solid insulation as forms for pouring concrete, the insulation being held together by clips. The insulation may be removed after the concrete is cured or may remain as insulation for the building.

A slip-form method that may be used for the pouring of vertical concrete walls includes the use of a separate polyethylene sheet or other suitable plastic film that rests against the surface of the concrete as it cures and permits the slip-form to be slowly raised up, leaving the plastic film in place, against the surface of the concrete. The slip-form is preferably made from plywood with a smooth surface finish such as a plastic coating. A frame behind the plywood provides the necessary strength to support the plywood when the liquid concrete is poured into the form. The plastic film must have a low coefficient of friction with the slip-form in order for the slip-form to be raised leaving the film in place. The plastic film may be stripped from the concrete after the slip-form has been removed and the concrete has cured. To improve the coefficient of friction between the slip-form and the plastic film some form of oil or lubricating material may be used.

Another system that may be used is a band-roller system, where metal or plastic bands act as the form; these are supported by rollers at top and bottom, and may be slowly raised as the concrete is poured. The concrete at the bottom hardens and the bands are slowly raised to permit concrete to be poured in at the top before the surface of the concrete sets thus avoiding a cold joint. Such a system is essentially practical when a series of multicellular, monolithic concrete structures are to be prepared.

Regular slip-form methods are recognized as being capable of extruding vertical concrete walls having a thickness of at least eight inches. If the thickness is less than 8 inches, then the friction forces due to the weight of concrete against the slip-form creates problems in separating the slip-form from the concrete. Slip-form panels are preferably made of three-fourths inch plywood and are mounted on platforms which may be raised and lowered as a whole by means of hydraulic jacks. By the use of a thin film of plastic such as polyethylene, the thickness of the walls may be considerably reduced as the plastic film against the concrete surface reduces the friction between the slip-form and the plastic film, the plastic film remaining on the concrete. By this method, vertical walls having a thickness of less than six inches may be extruded satisfactorily.

Other materials than concrete may be used to construct the multicellular, monolithic structure; these include wood or plastic laminates of sandwich type construction, extruded foam with wood, metal or plastic reinforcing, and other new light weight building materials now being experimented with. It is important, however, that whatever materials are used the layers or other materials must all be firmly joined together to form the monolithic structure. Referring again to FIg. 1, the structure is erected by tilting it about the tilt line 10. When it is in the upright position, the walls 11, 12, 13 become the transverse bearing walls of the structure, the walls 14, 15, 16 become the floors of each storey, and in the case of the top floor 16, perhaps the roof of the building. It is not essential that walls 14, 15 and 16 are only located between the walls 11, 12 and 13. Extensions from walls 14, 15 and 16 may protrude beyond the walls and floor slabs so that they become cantilevered floor sections suitable for balconies or used in joining two or more structures together to form halls or corridors. It will be apparent to those skilled in the art that the walls need not necessarily be equidistant apart, nor need the rectangular cells be the same size. In this manner, the transverse bearing walls may be spaced to conform to desired architectural layouts. Corridors, halls, staircases and rooms may be incorporated within the structure and if desired the finishing of the walls and floors may be incorporated to satisfy the architectural finishing requirements before tilting the structure to its vertical location. Once the structure has been tilted to its vertical location, additional walls may be required at each end. If the structure is made in two halves, a second tilt line is spaced apart from the first tilt line such that when the second multicellular, monolithic structure is tilted into its vertical location, it mates with the first structure. The end walls and intermediate walls of the two structures may be curtain walls, glazed or pre-cast, and are placed in position where necessary. Balconies may be added if desired. In some cases a space may exist between two adjacent structures and this may be filled by means of pre-cast concrete panels, which form floors and other connecting walls. The sectional depth and height of a multicellular, monolithic structure varies depending on the site and architectural requirements. It is to be appreciated that the structure must be designed so that when lifted about its top corner it does not collapse and the structure at the fulcrum tilt line must have sufficient strength to take the load of the structure as it is raised. Similarly, one must consider the capacity and boom height of the crane or cranes required to raise the structure to its vertical location. These two factors restrict the size of the structure. The width and thickness of walls and floors have also to be taken into account to ensure they can be formed and have sufficient strength. The type of concrete to be used is equally important; if a light weight concrete is used, it may be possible to form five stories in one multicellular, monolithic structure which may then be tilted to its vertical location.

Figure 2:
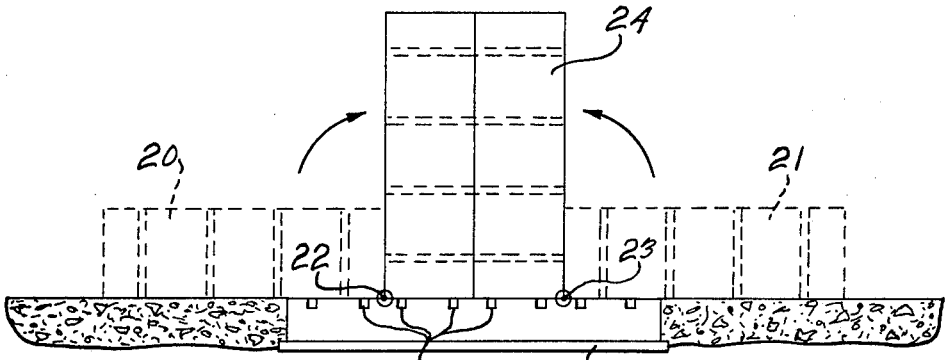
FIG. 2 is a schematic elevational view of the fulcrum tilt system, with two opposing multicellular, monolithic structures, tilted from the horizontal to the vertical position.
Figure 3:
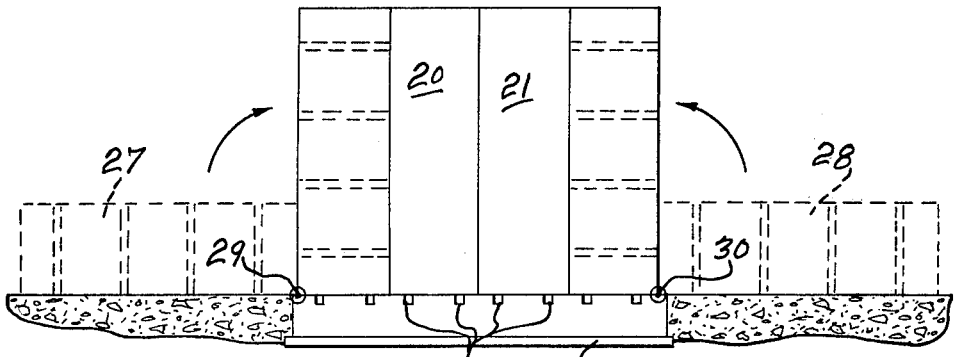
FIG. 3 is a schematic elevational view of a continuation of the structure shown in FIG. 2 with two multicellular, monolithic structures tilted from outside the two existing erected monolithic structures.

FIG. 2 shows two multicellular, monolithic structures 20 and 21 each having four stories which are assembled in a horizontal position and then tilted about their appropriate fulcrum tilt lines 22 and 23 into a vertical location where they mate to form a single building 24. The foundation walls 25 are formed before tilting the structures into their vertical location and contain strengthened positions at the tilt lines 22 and 23 and pockets 26 in the walls 25 for jacks so the structures may be levelled after they have been raised. Once the first two structures 20 and 21 are erected, as shown in FIG. 2, two further multicellular, monolithic structures 27 and 28 are assembled in the horizontal position, as shown in FIG. 3 and then tilted about fulcrum tilt lines 29 and 30 into a vertical location, thus increasing the size of the building. In the same way, the foundation walls 25 have strengthened positions at tilt lines 29 and 30 and pockets 26 in the walls 25 for jacks to level each structure after erection.

Figure 4:
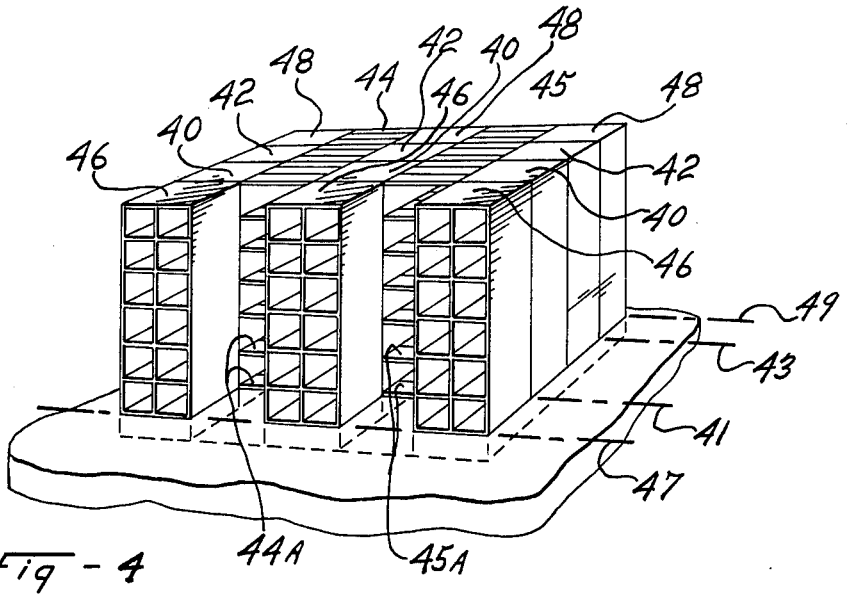
FIG. 4 is a schematic perspective view of an erected building formed from multicellular, monolithic structures, which have been tilted into the vertical position.

A building that has been assembled from a number of multicellular, monolithic structures is shown in FIG. 4. In the construction of this building, a first row of three multicellular, monolithic structures 40, each having two rows of five cells, are first assembled in a horizontal plane, then tilted about a tilt line 41 to a vertical location. At the same time, a second row of three multicellular, monolithic structures 42 are assembled in a horizontal plane and then tilted about a tilt line 43 to a vertical location and mate with the three structures 40 in the first row. Spaces 44 and 45 remain between these mated structures in the rows and these in turn are filled with pre-cast concrete floor slabs 44A and 45A that are erected on each floor after the structures have been tilted to their vertical locations. In the next step, a third row of three multicellular, monolithic structures 46 are assembled in a horizontal plane and are tilted about tilt line 47 to their vertical locations so that they mate with the three structures 40 in the first row. At the same time, a fourth row of three similar structures 48 are assembled in a horizontal plane and tilted about a tilt line 49 to their vertical locations such that they mate against the three structures 42 in the second row. Precast concrete panels are erected in the spaces 44 and 45 between the structures, and interior and exterior end walls are installed to complete the structure of the building.

The embodiment shown in FIG. 4 has tilt lines in one plane only. However, it will be apparent to those skilled in the art that the tilt lines could be in two planes at right angles to each other. This would provide vertical walls at right angles to each other. The multicellular, monolithic structures may be tilted to a vertical location so that all four sides of the structure eventually mate with adjacent structures. Alternatively only two opposing sides mate with adjacent structures as shown in FIG. 4 or in some cases no sides mate with adjacent structures. The spaces between the structures may be joined by floor slabs erected on each floor after the structures have been tilted to their vertical location and prefabricated end walls may be erected as required. The structures may be formed so that cantilevered floor sections mate between adjacent structures to avoid the necessity of having a vertical wall of one structure mating with an adjacent vertical wall of another structure.

Figure 5:
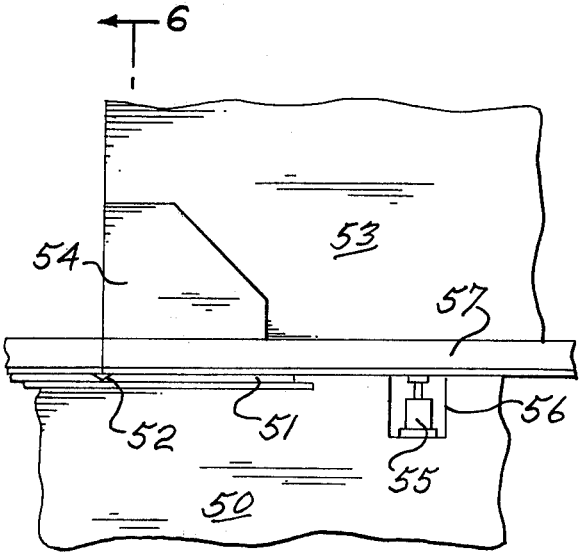
FIG. 5 is an end view at the location of the fulcrum tilt showing a multicellular, monolithic structure in the upright position.
Figure 6:
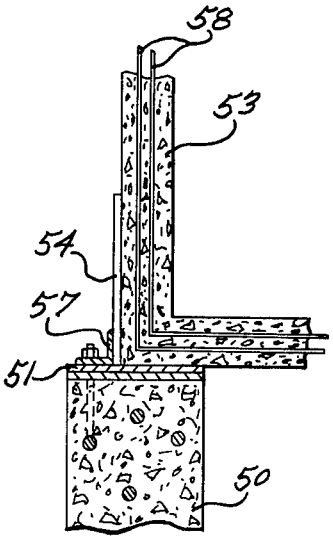
FIG. 6 is a cross-sectional elevational view through the side of a multicellular, monolithic structure adjacent the location of the fulcrum tilt showing a guide angle retaining the structure in the correct location after tilting to the upright position.

An example of the fulcrum tilt position is shown in FIG. 5. A foundation wall 50 has a plate 51 mounted thereon and connected to reinforcing steel in the foundation wall 50. The plate has a V-notch 52 which forms the tilt line. A corner of the multicellular, monolithic structure 53 is shown in the vertical location, and has strengthened corner plates 54, preferably made of steel, positioned so that when the structure is tilted the corner plates 54 or tilt points are initially retained in the V-notch 52 and moves within the V-notch until the structure has moved through 90°. A jack 55, preferably a hydraulic jack, is located in a pocket 56 in the foundation wall 50 and is used for levelling the structure when it is raised to the vertical location. FIG. 6 shows a section through the foundation wall 50 with a guide angle 57 mounted on the steel plate 51 to act as a guide and retain the structure 53 in its correct location. The structure 53 has reinforcing steel 58 therein and is formed from concrete.

In the method of construction, the multicellular, monolithic structure first is assembled in the horizontal position in the manner disclosed herein. If the unit is made from concrete then it is essential to ensure that the concrete is cured before the tilting step commences. If it is formed from laminates such as wood or plastic then the laminate must be set before the tilting step commences to ensure that the structure has sufficient strength to avoid collapsing during the tilting step. Before commencing the next step, the location of the structure is checked to ensure it is in the correct position for the tilt step, the foundation walls are firm and the tilt plates 51, as shown in FIG. 5, are located with the V-notch 52 at the tilt line. The step of tilting is preferably carried out by two cranes although in small structures one crane is sufficient. Lifting hooks are connected at each side of the structure to a standard lifting bar or sling arrangement which is attached to the four top corners of the structure. When the lift commences the load comes on the two uppermost corners of the structure; then, as the cranes raise the structure and commence tilting it about the tilt line, the load spreads to the four corners of the structure until eventually when the centre of gravity of the structure passes over the tilt line, the load is transferred to the two uppermost corners again and the cranes prevent the structure from lowering too fast and damaging the foundation walls. Once the structure has been raised to its vertical location and is aligned within the angles 57, then the jacks 56 are used to ensure that the structure is level. After levelling, the jacks are removed and replaced by wedges or spacers on the foundation walls as required. After the structure has been tilted to its vertical location and levelled then exterior end walls may be added and internal walls as required. If the structure is to mate with one or more other structures, then it is necessary to ensure that the mating structures line up both vertically and horizontally. This may be done by the jacks. Curtain walls, glazed or pre-cast, may be fixed to the cell floor edges in the open ends of the structure. Recessed balconies, prefabricated internal walls or plain and simple masonry walls may be erected as required.

It will be appreciated that foundation walls may not be required and other types of foundation or slab may be used for a building. Such a system may be incorporated in the present invention in place of the foundation walls shown in FIGS. 5 and 6. In effect, a slab or raft foundation would reduce pressure at the line of contact during the tilting step, because the contact would not be restricted to the foundation walls.

Figure 7:
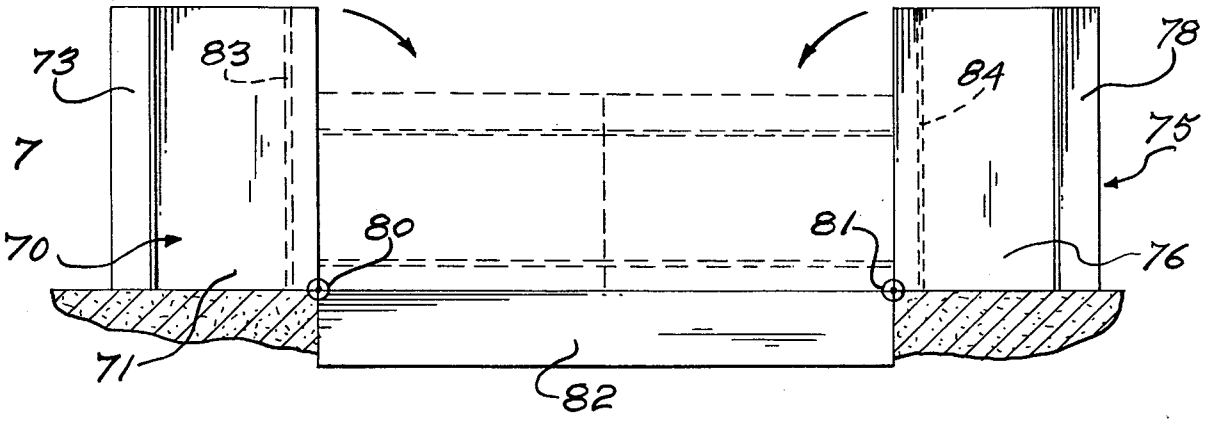
FIG. 7 is a side elevational view of a further embodiment of a multicellular, monolithic structure cast in two halves and then tilted to form a building.
Figure 8:
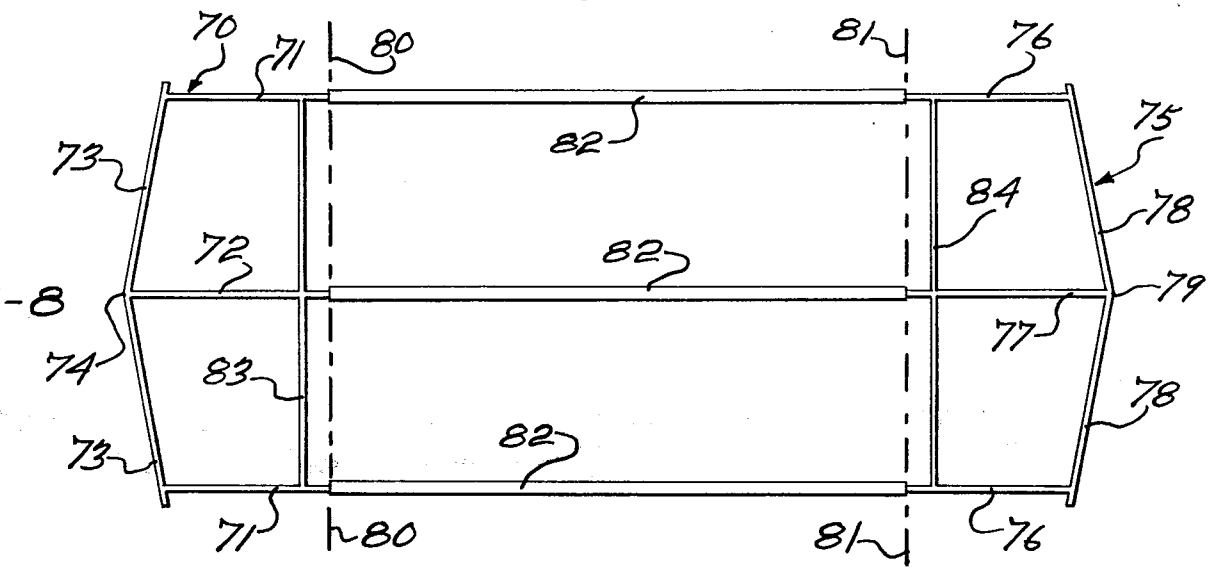
FIG. 8 is a plan view of the embodiment shown in FIG. 7.

Another embodiment of the present invention is shown in FIGS. 7 and 8. This embodiment is of particular interest in low-cost housing. Two halves of a house are assembled in a horizontal position. The first half 70 has two external walls 71, an internal wall 72 and a sloped roof 73 meeting at a central ridge 74. The second half 75 has two external walls 76, an internal wall 77 and a sloped roof 78 meeting at a central ridge 79.

The first half 70 has a tilt line 80 and the second half 75 has a tilt line 81. Foundation walls 82 match the external and interior walls of the two halves which both have floors 83 and 84. When the two halves are tilted to their vertical locations, the walls 71, 72, 76 and 77 of the two halves 70 and 75 rest on the foundation walls 82 and a basement is formed beneath the floors 83 and 84 within the house. The two halves 70 and 75 are tilted about the fulcrum points 80 and 81 to their vertical locations and a seal is provided between the two halves to prevent moisture entering the house or heat escaping from the house. Hydraulic jacks may be used as required to ensure that the two halves 70 and 75 meet after they have been tilted to their vertical locations and are correctly aligned. End walls, staircases and other interior walls and partitions are preferably pre-cast and assembled after the two halves are erected. The multicellular, monolithic structure gives strength to the structure during the tilting step. The tilting of each half may be done by means of one crane with a lifting bar or sling arrangement attached to the two corners on each side of the central ridge 74, 79 of the roof 73, 78 or by two cranes each having a lifting bar arrangement attached to the four top corners of the structure.

Figure 9:
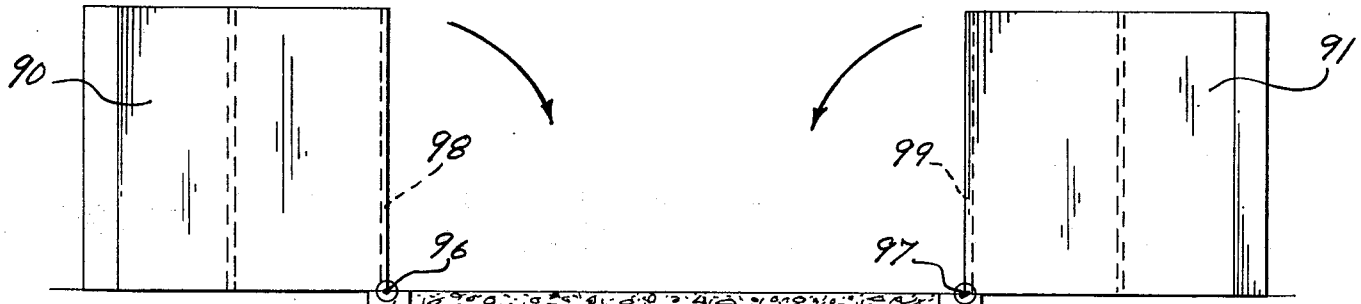
FIG. 9 is a side elevational view of yet another embodiment of a multicellular, monolithic structure cast in two halves and then tilted to form a building.
Figure 10:
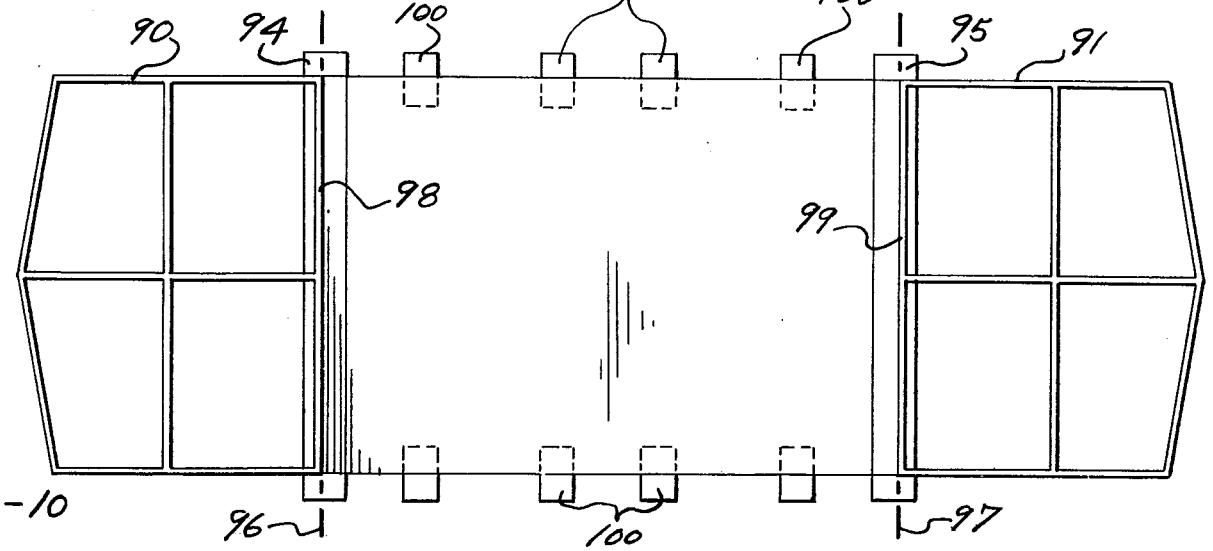
FIG. 10 is a plan view of the embodiment shown in FIG. 9.

Yet a further embodiment of the invention is shown in FIGS. 9 and 10 where a first structure 90 and a second structure 91 are tilted to a vertical location to mate and form a twostorey house. In this concrete foundation walls are required. A shallow pit 92 is prepared and filled with crushed stone 93. Two concrete strips 94 and 95 are prepared to support tilt lines 96 and 97. Each structure is assembled with a base floor 98 and 99 in place. Thus after the tilting step the base floors 98 and 99 rest on the crushed stone 93. Concrete pads 100 are positioned at the sides of each structure to allow jacks to be used to level the two structures. The blocking or wedges may then be added and the jacks removed. A strong connection between the two halves is required to prevent their separating after the house has been assembled. This embodiment allows a house to be constructed without having to pour a concrete slab in the horizontal location. Only concrete strips 94 and 95 are required together with concrete jacking pads 100. In cold climates these strips and pads preferably have foundations below the frost line to prevent the completed building heaving in the spring thaw.

It will be apparent to those skilled in the art that a number of variations may be made within the framework of the present invention without departing from the scope thereof. It will be apparent to those skilled in the art that the engineering design of a structure suitable for tilting according to the present invention may be carried out without any inventive concepts being applied. Stresses due to the tilting step may be calculated dependent upon the weight of the structure and the design of the structure made to contain these stresses. The use of the crane is within the skill of a crane operator, the one tricky point being where the centre of gravity of the structure passes over the tilt line. Cranes have been referred to in this disclosure, but other lifting devices including jacks and winches may be suitably employed. The scope of this invention is not limited to buildings but may include other structures such as bridges, overpasses and the like.

The embodiments of the invention in which an exclusive property of privilege is claimed are defined as follows:

1. A method of constructing a building comprising the steps of:

forming at least one multicellular, monolithic structure on a horizontal plane, the formed structure having only vertical walls and having a forward lower edge in said horizontal plane;

providing a V-notch in the horizontal plane adjacent to said lower forward edge of said structure but out of contact therewith;

sliding and tilting said structure forward about said lower forward edge thereof until said edge enters and rests in said V-notch;

tilting said structure about said V-notch, and raising said structure to a vertical location, said lower forward edge leaving said V-notch during the raising of said structure; and leveling said raised structure.

2. The method of constructing a building wherein a plurality of multicellular monolithic structures are assembled according to the method of claim 1 wherein spaces are provided between each structure and further including the step of filling each space with preformed floor slabs.

3. The method of constructing a building according to claim 1 wherein said forming step comprises forming the multicellular, monolithic structure in a horizontal plane by the slip-form method of pouring concrete which comprises providing a slip-form, pouring concrete into said slip-form, raising said slip-form, and repeating said pouring and raising steps a predetermined number of times.

4. The method of constructing a building according to claim 1 wherein the forming step comprises providing monolithic structure concrete forms made from rigid insulation, pouring concrete into said forms, leaving said forms in place after the walls are formed so that the rigid insulation remains with the structure to provide insulation for the building.

5. The method of constructing a building according to claim 1 and further including the additional steps of:

forming end walls from pre-cast panels; and erecting the end walls after the structure has been tilted to the vertical position.

6. The method of constructing a building according to claim 1 wherein the step of providing a V-groove in the horizontal surface includes positioning a steel plate with a V-notch in the horizontal surface.

7. The method as claimed in claim 6 wherein said lower forward edge is defined by at least two corners, said method further comprising the step of positioning and attaching strengthened corner plates onto the corners of the formed structure, said corner plates being positioned and attached such that when said structure is tilted, said corner plates enter and rest in said V-notch.

* * * * *